United States Patent [19]

Klein

[11] Patent Number: 5,007,191

[45] Date of Patent: Apr. 16, 1991

[54] BUSINESS CARD AND CARD STOCK WITH LIFT-OUT PANEL AND BONDED EDGES

[76] Inventor: Gerald B. Klein, 13451 Stuart Ct., Broomfield, Colo. 80020

[21] Appl. No.: 267,859

[22] Filed: Nov. 7, 1988

Related U.S. Application Data

[63] Continuation-in-part of Ser. No. 177,375, Apr. 4, 1988, Pat. No. 4,905,392.

[51] Int. Cl.[5] ..... G09F 3/10

[52] U.S. Cl. ..... 40/638; 40/360; 281/5

[58] Field of Search ..... 40/594, 638, 360, 373, 40/390, 299, 404, 595; 283/61, 62, 103, 105, 101; 428/42; 281/5

[56] References Cited

U.S. PATENT DOCUMENTS

| | | | |
|---|---|---|---|
| 2,321,184 | 6/1943 | Butterworth | 428/42 |
| 2,521,435 | 9/1950 | Wockenfuss | 281/5 |
| 2,805,816 | 9/1957 | Morgan | 40/299 |
| 3,304,102 | 2/1967 | Huffman | 281/5 |
| 3,508,754 | 4/1970 | Shorin | 428/42 |

*Primary Examiner*—Cary E. Stone
*Attorney, Agent, or Firm*—Dennis O. Kraft

[57] ABSTRACT

A business card is formed as a laminate comprising an information-carrying face sheet and a protective backing sheet which enhances the rigidity of the face sheet. The face sheet has a contact adhesive at its back surface which bonds the face sheet and backing sheet together, and is provided with a score cut about its edge portions which defines a lift-out panel whereon the information is printed and margin portions at the edges of the card. The backing sheet has a release surface engaging the lift-out panel permitting the lift-out panel to be removed and be affixed to other surfaces such as a file card while the marginal surfaces of the backing sheet engage the margin portions of the face sheet and are tightly and permanently adhered thereto. In the preferred embodiment, the release surface extends a short distance beyond the score cut to facilitate removal of the lift-out panel. The panel may be proportioned to properly fit the surface of file cards of standard sizes. Card stock for manufacturing the business card is also disclosed.

11 Claims, 4 Drawing Sheets

BUSINESS CARD AND CARD STOCK WITH LIFT-OUT PANEL AND BONDED EDGES

This is a Continuation-in-part of application Ser. No. 177,375 filed Apr. 4, 1988 and entitled Adhesive Backed Business Card for Mounting on a File Card, now U.S. Pat. No. 4,905,392.

BACKGROUND OF THE INVENTION

This invention relates to information bearing cards such as business or calling cards (hereinafter referred to as "business cards") and more particularly to a business card having an adhesive backed panel which may be mounted upon the file card of a file card storage system.

Many file card systems are available for use in storing, indexing, and retrieving information such as names, addresses, telephone numbers and the like. Typically, the user of such file card systems is required to remove a particular file or index card, and either print or type information upon same, the file or index card thereafter being reinserted into its holder or frame therefor. These conventional file card systems do not readily accommodate persons who may receive business or calling cards and the like (all such cards being generically referred to hereinafter as "business cards"), which persons may desire to not only file the information on such business card, but to retain the business cards per se'. Such a person is required to remove a conventional file or index card from its frame or holder and print or type thereon the information obtained from a business card, with the business cards being thereafter stored in a haphazard fashion or even disposed of.

In the typical business setting, the transfer of information from a business card to a file or index card therefore requires a significant amount of effort, so much so that same is oftentimes overlooked. Further, the retention and storage of business cards is quite unorganized and such business cards are readily misplaced as a result. Also, the improved business cards, herein disclosed, may be used in other ways, such as pasting the cards on bulletin boards, affixing them to special correspondence and the like.

OBJECTS

A need clearly exists for a mechanism or system which eliminates the typical problem of haphazard storage of business cards and, at the same time, assures that the information on such business cards is readily and effectively available for storage and retrieval. It is the primary objective of the instant invention to provide an apparatus which satisfies this need, an apparatus which serves to readily and efficiently retain and display business cards.

A further objective of the instant invention concerns the provision of an apparatus which can markedly reduce the work effort involved in transferring pertinent information from a business card onto a file or index card.

Yet another objective of the instant invention is the provision of an apparatus which allows a business card to be directly affixed to a file or index card, thus eliminating the opportunity for a typist or secretary to make an error in transcribing information from the business card to the file or index card.

A further need exists in that business cards constructed according to the disclosure set forth in the prior Application Ser. No. 177,375 herein referred to, "Adhesive Backed Business Card For Mounting On File Card," can, when used in a general manner and not as therein disclosed, be mishandled and abused to the point where the protective release sheet becomes separated from the adhesive backing. Bending the card or folding or 'dog-earring' the corners can cause this. Another object of the invention is, thus, to provide a novel and improved business card which is sufficiently stiff and rigid and otherwise constructed as to retain its integrity, with the release sheet remaining in place until the card is ready for use.

BRIEF SUMMARY OF INVENTION

These as well as other objectives are implemented by the instant invention which, as aforementioned, is directed to the provision of an adhesive-backed business card which may be affixed to a file or index card which may, in turn, be carried in a frame means capable of holding a multiplicity of filed cards. Business cards and file cards are in extensive use throughout the country and, to a great extent, have become standardized in size and form. Thus, it becomes essential that the attachment of a business card to a file card be accomplished without requiring a variation of one or the other from a standardized size.

The difficulty in accomplishing this is clearly demonstrated by comparing the size of a standard business card with the size of a most popular file card of the type which is commonly carried upon a card-holding frame means. A common business card is 3½ inches wide by 2 inches high. The popular file card has a usable face surface which is 4 inches wide and 1¾ inches high. Unless the business card is trimmed, it will not fit on the file card.

In essence, the present invention solves this problem by providing a business card having a contact-adhesive back surface normally covered by a release sheet which is to be removed when the card is to be mounted. The release sheet actually carries the business card, and the card is score-cut about its edge portion to provide a rectangular lift-out panel no more than 1¾ inches high and is proportioned to properly fit the available usable surface of the popular file card. All of the printed information on the business card is in the lift-out panel and thus, the lift-out panel forms a novel and useful combination with the popular sized file card in a simple, effective manner.

The problem brought about by the protective release sheet accidentally separating from the contact-adhesive back surface of the business card when the card is used for other purposes is minimized or substantially eliminated by eliminating the release sheet and providing a backing sheet treated with a release agent only at its central portion, at the area of the lift-out panel of the face sheet of the business card, with the untreated marginal edge portions of the backing sheet tightly and permanently to the marginal edges of the face sheet of the business card.

BRIEF DESCRIPTION OF THE DRAWINGS

The invention itself will be better understood, and further features and advantages thereof will become apparent from the following detailed description of a preferred inventive embodiment, such description making reference to the appended four sheets of drawings wherein.

DETAILED DESCRIPTION OF THE INVENTION

Figure 1:
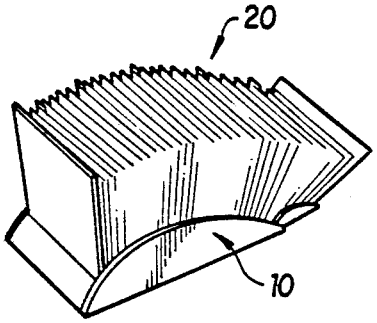
FIG. 1 is a perspective illustration of a file or index card displaying apparatus constructed in the form of a tray or box.

With reference now to the drawings, and particularly to FIG. 1 thereof, one form of an apparatus is disclosed suitable for use in retaining and displaying business cards. The apparatus will be seen to comprise a frame means or card holder generally designated by reference numeral 10 adapted to receive and hold a multiplicity of planar sheets generally designated by reference numeral 20 which comprise file or index cards constructed in the manner depicted in FIG. 3, for example.

Figure 2:
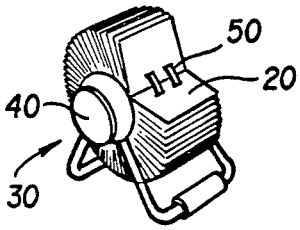
FIG. 2 is a perspective illustration of a file or index card displaying apparatus constructed in the form of a rotary "flipfile"

An alternative construction of a frame means is that depicted in FIG. 2, wherein the frame means 30 therein is constructed as a rotary "flip-file" containing a central wheel 40 having rods or channels 50 disposed thereon so as to hold the multiplicity of file or index cards 20 therein. As the rotary wheel 40 is turned, the multiplicity of file or index cards "flip" and the information upon each card is readily visible to the user. Frame means such as is shown in FIGS. 1 and 2 are generally known to the public and can be obtained from most office supply sources.

Figure 3:
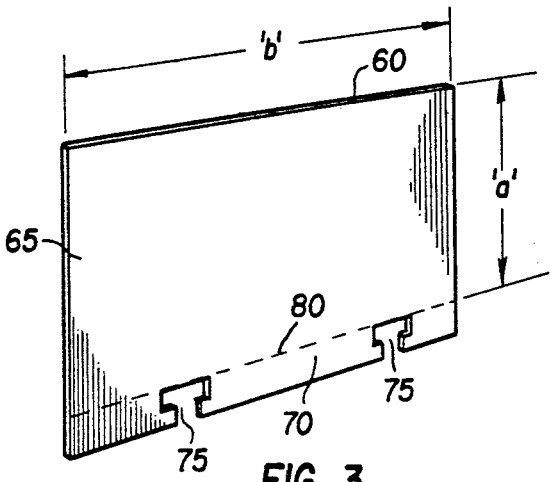
FIG. 3 is a perspective illustration of a file or index card suitable for use with the present invention.

With reference now to FIG. 3 of the application drawings, a typical planar sheet 60 constituting a file or index card is shown, the card being constructed of relatively stiff paper material. The card has a plane, flat surface consisting of two portions, an information carrying surface 65 and a mounting edge means 70 wherein means such as slots 75 may be provided for removably attaching the planar sheet or card 60 to the frame means 10 or 30 as shown in FIG. 1 or 2. The mounting edge means 70 can include attaching means other than slots 75, such as tabs, for example (not shown). The dashed line 80 between the information carrying surface 65 and the mounting edge means 70 defines the extent of the height 'a' of the information carrying surface which on a popular sized file card 60 is $1\frac{3}{4}$ inches high. The width 'b' of the card is normally 4 inches.

Figure 4:
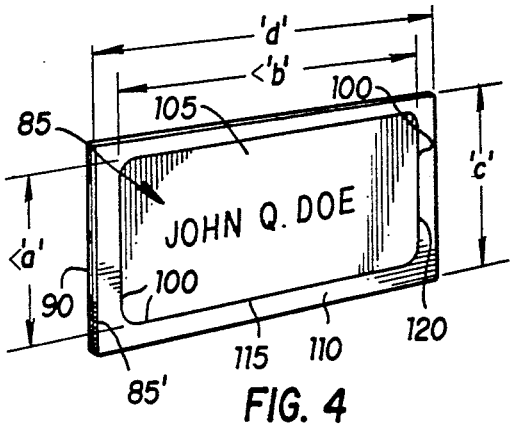
FIG. 4 is a perspective illustration of a common business card modified for use in the present invention.
Figure 5:
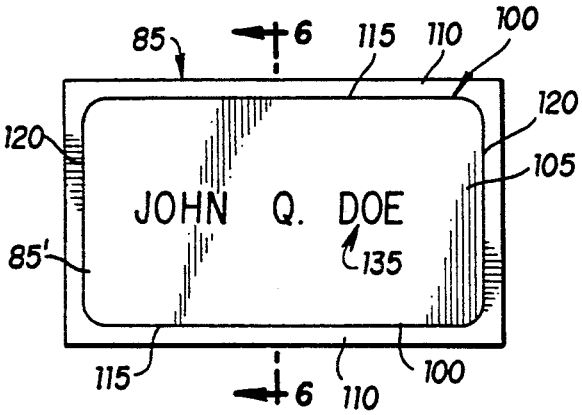
FIG. 5 is an elevational view of the business card shown in FIG. 4 but with a face score-cut being specifically illustrated.
Figure 6:
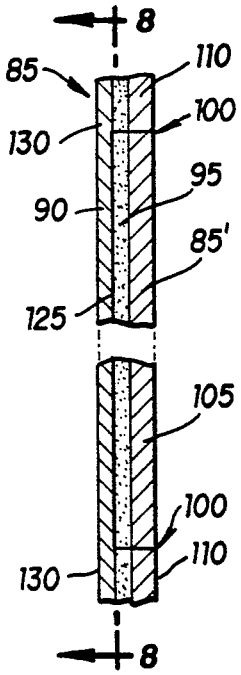
FIG. 6 is a transverse section of the card as taken from the indicated line 6—6 in FIG. 5 but on a greatly enlarged scale and with the center portion broken away to conserve space.
Figure 7:
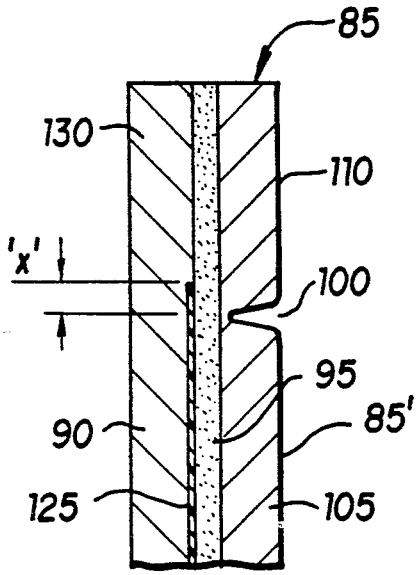
FIG. 7 is a fragmentary portion of the section shown at FIG. 6 but on a further enlarged scale.
Figure 8:
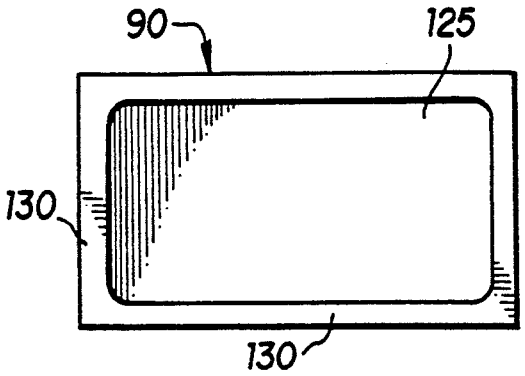
FIG. 8 is an elevational view of the backing sheet which is mounted at the back of the face sheet, as would appear from the indicated line 8—8 at FIG. 6.

FIGS. 4, 5 and 6 show the improved business card 85 which is preferably proportioned the same as standardized business cards, having a height 'c' of 2 inches and a width 'd' of $3\frac{1}{2}$ inches. This card is formed as a laminate of relatively stiff paper material including an information-carrying face sheet 85' and a backing sheet 90. These sheets are secured together by a contact adhesive 95, FIG. 6.

A rectangular score 100 is cut in the face sheet 85' about marginal edge portions of the face sheet to define a lift-out panel 105 and a marginal edge strip 110 about the panel. The lift-out panel 105 will contain the information printed on the face sheet and can be removed from the body of the card as hereafter described. To fit the usable face surface 65 of a file index card 60, the vertical space between the horizontal line positioned 115 of the score cut 100 must not be more, and preferably slightly less, than the height 'a' shown at FIG. 3. Also the horizontal space between the vertical line portions 120 of the score cut 100 must not be more, and preferably slightly less, than the width 'b' shown at FIG. 4. In a standard file card 60, where the width 'b' is 4 inches and in a standard business card the width 'd' is $3\frac{1}{2}$ inches, the vertical line portions 120 of the score cut 100 are unnecessary when used with standard file card 60. However, both the horizontal and vertical portions of the marginal edge strip 110 are desirable whenever the improved business card 85 is used for other purposes as hereinafter described.

Figure 9:
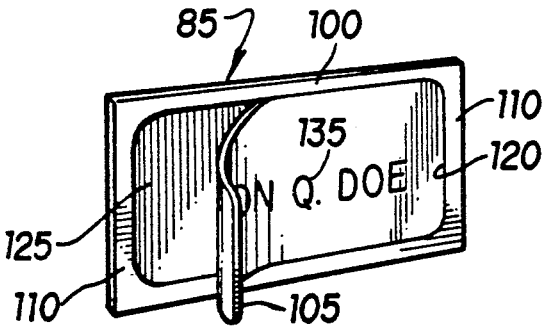
FIG. 9 is a perspective illustration similar to FIG. 4 but with the lift-out panel of the business card being partially removed.
Figure 10:
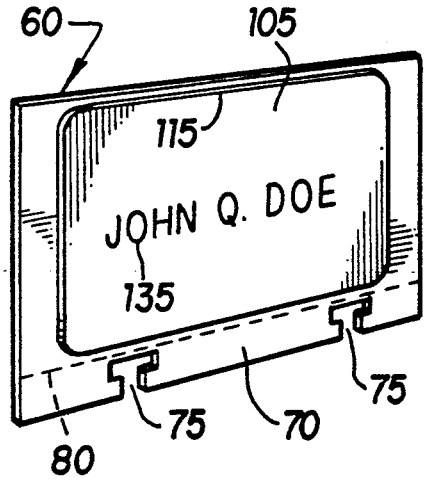
FIG. 10 is a perspective illustration similar to FIG. 3 but showing the lift-out panel being mounted upon the file card.

The application of the lift-out panel 105 of the business card 85 to the file card 60 is very simple. As shown in FIG. 9, this panel 105 may be lifted from the business card 85 with the contact adhesive intact as will be described and simply affixed to the usable surface 65 of the file card 60 as shown in FIG. 10. It is to be noted that the panel 105 may also be used in a like manner with file cards larger than the file card 60 and for other similar purposes.

The backing sheet 90 of the business card 85 is adapted to be secured to the face sheet 85' as a laminate by the contact adhesive 95 with this laminate forming a business card which in ordinary use is sufficiently stiff to resist inadvertent bending, especially at the corners. However, to permit the lift-out panel 105 to function as above described, the central portion of the backing sheet 90 is treated with a release agent to provide a release surface 125 which will not adhere with the contact adhesive layer 95 of the lift-out panel 105. At the same time, the edge margins 130 of the backing sheet 90 will be tightly and permanently bonded to the corresponding edge margins 110 of the face sheet 85'

FIGS. 5, 6, 7, and 8 illustrate the construction and components of the laminated business card 85. The face sheet 85, FIG. 5, includes printed information 135 within the liftout panel 105, the score cut 100 defining the panel and the marginal edge strip 110. The backing sheet 90, FIG. 8, includes the treated release surface 125 and the untreated edge margins 130. The release surface 125 is shaped and proportioned to match the lift-out panel 105 to permit the panel to be removed from the body of the card. Preferably, this release surface 125 will extend beyond the panel 105 surface defined by the score cuts 100 as indicated by 'x' at FIG. 7. The extension or lap 'x' need be only enough to assure easy removal of the lift-out panel.

It is to be noted that many types and grades of contact adhesives are available and a skilled technician can easily select a suitable contact adhesive for the purpose at hand. Release sheets and release agents are also well known to the art. However, applicant does not adopt the standard practice of treating an entire sheet with a release agent. Instead, applicants backing sheet 90 is of untreated cardboard or paper having a selected thickness and stiffness, and of a type which will accept and tightly adhere with the contact adhesive 95 at the back of the face sheet 85. A printing or lithographing operation is necessary to place the release agent on the backing sheet 90 to form the release surface 125 opposite the lift-out panel 105. A skilled printer or lithographer can select a suitable release agent material for this purpose, such, for example, a silicone-based oil having the general properties of an oil based ink.

Figure 11:
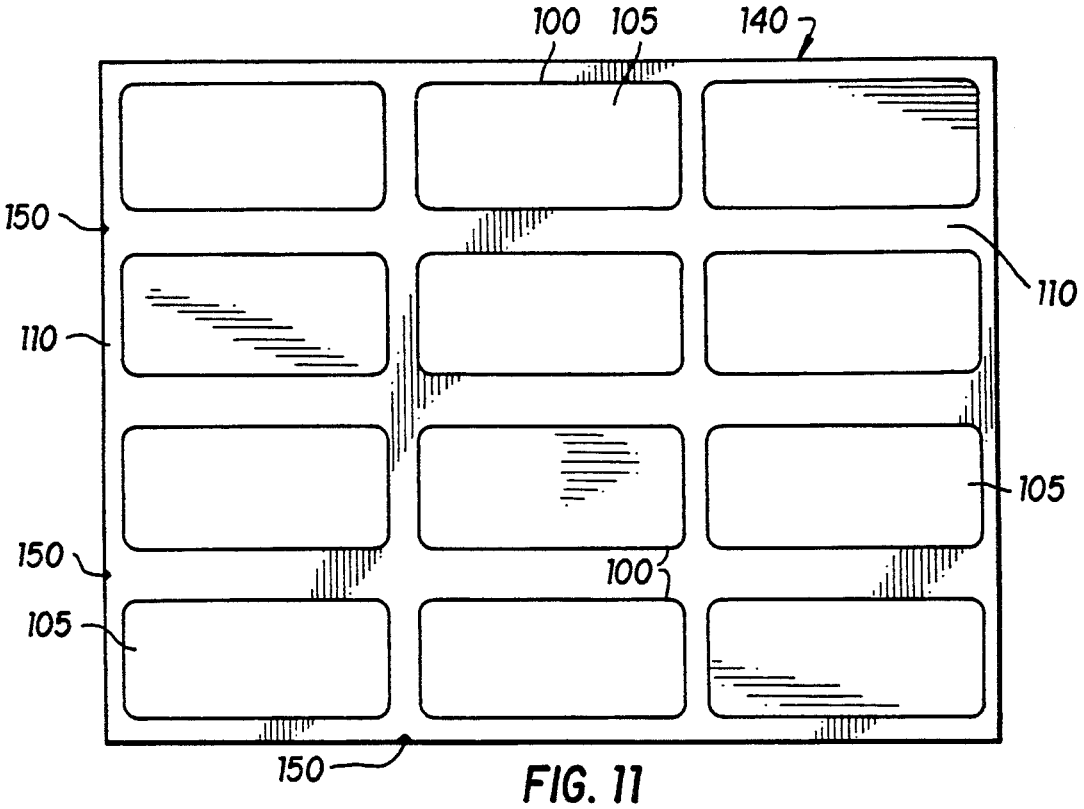
FIG. 11 shows a stock sheet of business cards having a plurality of scores marked thereon suitable for supply to a printer.
Figure 12:
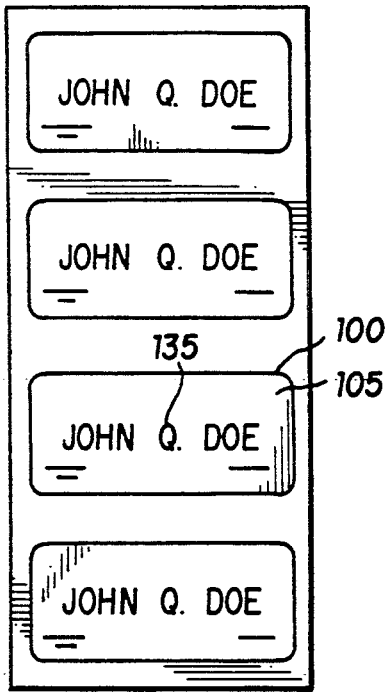
FIG. 12 shows a portion of the sheet of FIG. 11 cut to a convenient size by the printer with custom printing thereof.
Figure 13:
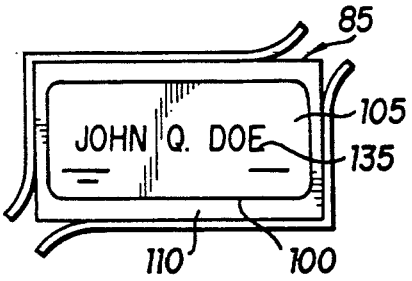
FIG. 13 shows a printed card being trimmed to size.

With reference now to FIGS. 11 through 14, a manufacturing and assembly technique is depicted. Finished business card stock supplied by the manufacturer will include paper face card stock 140, FIG. 11 with the contact adhesive 95 at the back side. A protective backing sheet stock 145 FIG. 14 against the contact adhesive surface, and the score cuts 100 defining the lift-out panels 105. The business card stock 140 may be furnished as 8½ by 11 inch sheets, which are suitable for printing a dozen cards. This card stock may be cut into smaller sections for printing as shown at FIG. 12 and finally as individual cards 85 as shown at FIG. 13. Other convenient sizes of stock and even continuous coils may also be furnished as desired depending upon the type of press available. In any event, in accordance with the invention the positioning of the cards on the sheet is predetermined. For example, FIG. 11 shows an 8½ by 11 inch sheet 140 wherefrom twelve conventionally sized 2 by 3½ inch business cards 85 may be produced with a minimum of stock loss. The panels 105 on this sheet may be cut by score dies after assembly of the face sheet and backing sheet with the sheet being precisely positioned by registration as other registration means at the edges of the sheet.

Figure 14:
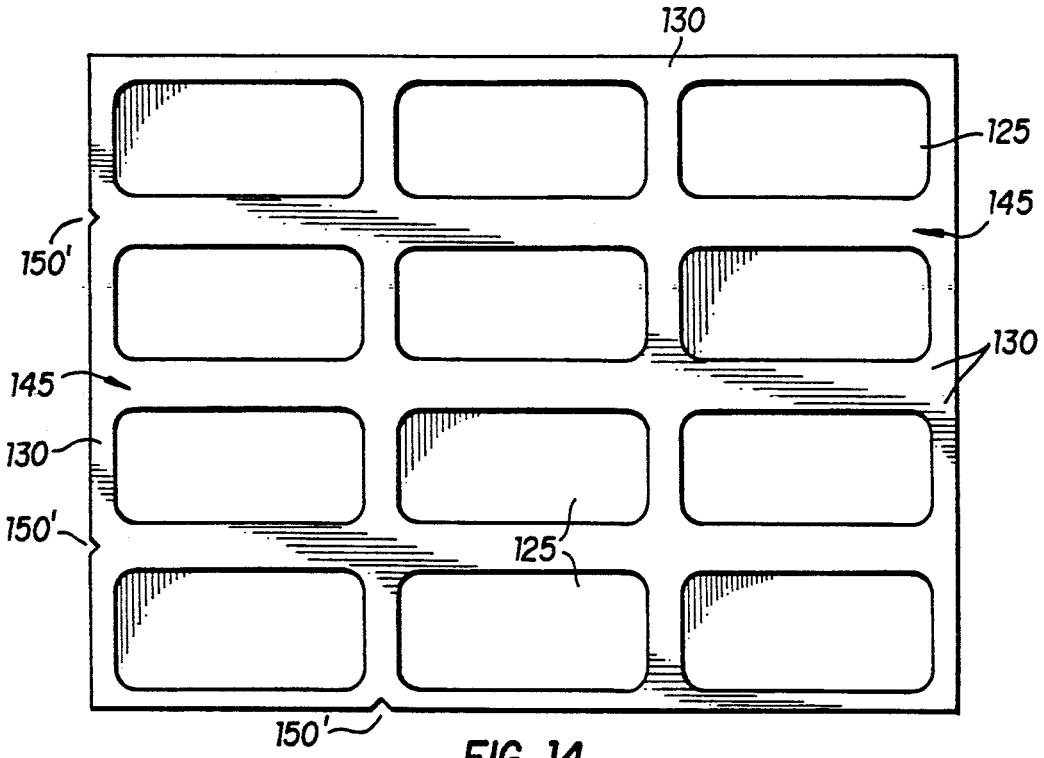
FIG. 14 shows the backing sheet portion of the stock sheet shown at FIG. 11 with cross hatching indicating areas treated with a release agent.

The backing sheet stock 145, FIG. 14, must be prepared in advance to its positioning on the face card stock 140 to form and properly locate the release surface areas 125. Precise registration of the backing sheet stock 145 with the face sheet 140 is thus essential; however, such is not beyond the ability of a manufacturer. A backing sheet stock 145 is sized to match the paper face sheet card stock 140, shown at FIG. 11, and with suitable registration means 150 to provide perfect registration therewith. A similar procedure is possible when other sizes of stock are used.

Figure 16:
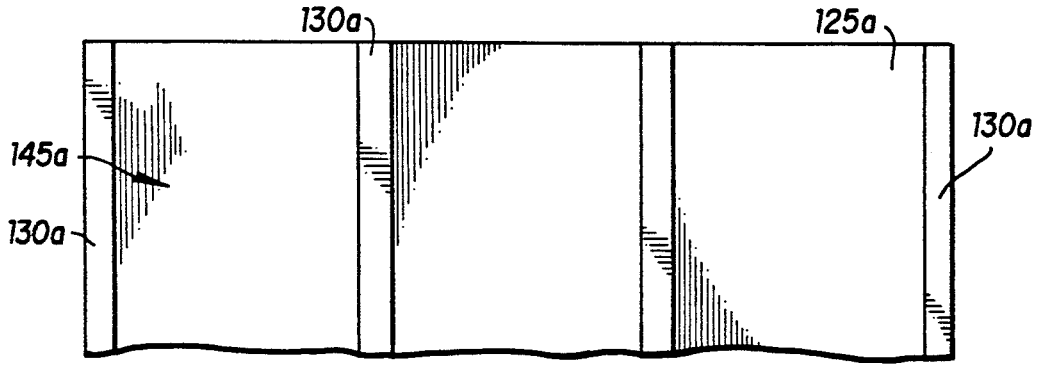
FIG. 16 is a fragmentary view, similar to FIG. 14 but showing an alternate arrangement of the release treated areas.
Figure 15:
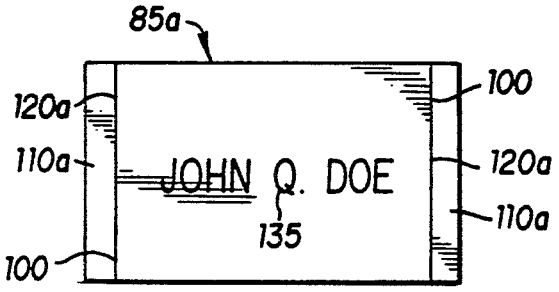
FIG. 15 is an elevational view of a business card similar to FIG. 5 but with a modified face score cut.
Figure 17:
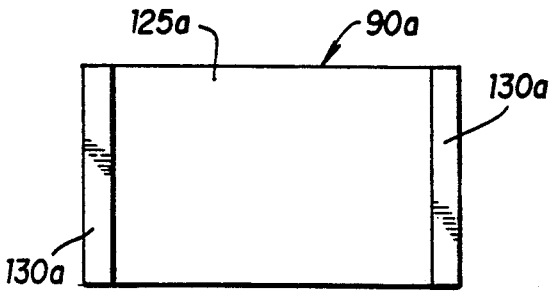
FIG. 17 shows a release sheet for a single card similar to FIG. 8 but with the alternate arrangement shown at FIG. 15.

FIGS. 15, 16 and 17 illustrate an alternate construction of a business card **85*a*. As shown at FIG. 15, in this arrangement vertical line portions 120*a* of the score cuts 100*a* are used to provide vertical edge margins 110*a*, while the horizontal line portions and horizontal edge margins are omitted. Accordingly, the lift out panel 105*a*** extends from the top to the bottom of the card. This arrangement may be reversed with vertical edge margins being eliminated and horizontal edge margins being provided.

The advantage of this arrangement lies in a significant simplification of the printing, scoring and application of a release agent **125*a*. To the backing sheet 90*a* for some, or even all of these, operations may be done continuously on a coater roll-type press in the arrangement illustrated at FIG. 16. The backing sheet stock 145*a* received continuous strips of release agents to provide continuous release surfaces 125*a*. Accordingly, registration in the vertical dimension is not critical. As long as the vertical edge margins 130*a*, as shown at FIG. 17 register with the vertical marginal edge strips 110*a* shown at FIG. 15, the height of the card may be optional. Although the construction of the card 85*a* will not be as rigid as card 85, the corners of the card 85*a* and the vertical edges 110*a*** will be reinforced and protected from separating.

Figure 18:
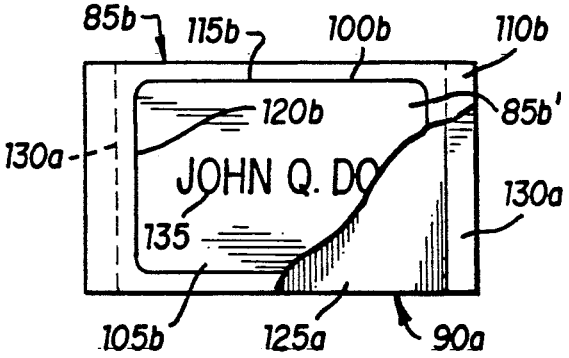
FIG. 18 shows an elevational view similar to FIG. 15 but with a further modification of the face sheet, and with portions of the face sheet broken away to show parts otherwise hidden from view.

A further modification of the invention is illustrated at FIG. 18 where the business card **85*b* is formed with the backing sheet 90*a* having opposing vertical edge margins 130*a* and a release agent 125*a* in the area between the edge margins. A modified face sheet 85*b'* having a contact adhesive at its back side secures the face sheet 85*b'* to the backing sheet 90*a* at the edge margins 130*a* as illustrated. However, the score cut 100*b* is not at these edge margins 130*a* as heretofore described but well within the area of the central portion of the backing sheet which is treated with a release agent. This score cut 100*b* defining a lift-out panel 105*b* may extend completely around the panel 105*b*** as illustrated or otherwise as desired.

In use, a business card formed as described herein is affixed to a file or index card, which file or index card would then be placed within the frame means or holding mechanisms 10 or 20. No laborious transfer of information from the business cards to the file or index cards is required, and the business cards are safely stored in a well-organized manner. Also, the business cards may be used in an ordinary manner without the edges of the backing sheet being unintentionally separated from the face sheet before the panel is ready to be lifted from the body of the card to affix it to a file or index card or to any other surface, such as a bulletin board or the like.

It should now be recognized that the objectives set forth at the outset of this specification have been successfully achieved.

I claim:

1. A business card, or the like, formed as a laminate including a face sheet adapted to carry information at its front side and having a contact adhesive at its back side, and a backing sheet secured to the face sheet by the contact adhesive, the improvement comprising:

(a) a score-cut means delineating and defining a lift-out panel in the face sheet and an edge margin strip between an edge of the panel and an edge of the business card; and (b) a release means on the backing sheet engaging the lift-out panel of the face sheet to permit the lift-out panel to be separated from the edge margin strip at the score-cut means and lifted out and removed from the body of the card with the contact adhesive at the back side of the lift-out panel being intact while the edge margin strip of the face sheet and corresponding marginal portion of the backing sheet remain tightly and permanently bonded together by the contact adhesive, said release means extending a short distance beyond the score-cut means and a short distance into the marginal edge strip, whereby to insure a positive and easy separation of the lift-out panel and contact adhesive thereon from the backing sheet.

2. The business card defined in claim 1, wherein said business card is generally rectangular in form and said score-cut means includes score-cuts adjacent to opposing edges of the card to define opposing edge margins with the lift-out panel of the face sheet and release means on the backing sheet lying between these opposing edge margins.

3. The business card defined in claim 1, wherein said business card is generally rectangular in form and said score-cut means includes a score-cut adjacent to each edge of the card to define a continuous, peripheral, edge margin about the card, with the lift-out panel of the face sheet and release means on the backing sheet lying within the confines of the said continuous edge margin of the business card.

4. Card stock material for the production and printing of business cards having lift-out panels within marginal confines of the cards, wherein said card stock material is proportioned such that one or more business cards may be prepared and cut therefrom at specific locations and wherein said card stock material includes;

(a) registration means on said card stock material to control the preparation and cutting of the cards;

(b) a face sheet having a face side whereon information may be printed and a back side;

(c) a contact adhesive adhered to the back side of the face sheet;

(d) score-cuts in the face sheet at said business card locations defining lift-out panels dimensioned to fit within the dimensions of the business cards to be cut from the stock and leave a marginal edge strip on the business cards when cut from the stock;

(e) a protective backing sheet against the contact adhesive at the back side of the face sheet, and;

(f) adhesive release means on the backing sheet in registration and opposite to said lift-out panels to permit the lift-out panels to be removed from the face sheet after the business cards are cut from the stock, but with the marginal edge strips of the face sheet tightly and permanently adhering to the corresponding edge strip portions of the backing sheet, said adhesive release means extending a short distance beyond the score-cuts and a short distance into the marginal edge strip, whereby to insure a positive and easy separation of each lift-out panel and contact adhesive thereon from the backing sheet.

5. In the card stock material defined in claim 4, wherein the dimensions of the lift-out panels of each business card are less than the dimensions of the business card, such as to permit the lift-out panel to be mounted upon a mounting sheet such as a file index card which has a smaller usable area than the business card.

6. A composite card stock material for production printing of business cards, said card stock material being proportioned such that one or more business cards may be cut therefrom at specific locations thereon in correspondence with registration means thereon, said card stock material comprising:

(a) a face sheet having a front side whereon information may be printed;

(b) a contact adhesive adhered to the back side of the face sheet;

(c) a protective backing sheet against the contact adhesive covering said back side;

(d) score-cuts in the card stock material at said business card locations defining lift-out panels and marginal edge portions in the face sheet within the business card locations, and;

(e) adhesive release means on the backing sheet in registration with the lift-out panels to permit the lift-out panels to be removed from the face sheet after the business cards are cut from the card stock material, and with the marginal edge portions of the face sheet tightly and permanently adhering to the corresponding edge strip portions of the backing sheet, said adhesive release means extending a short distance beyond the score-cuts and a short distance into the marginal edge portion whereby to insure a positive and easy separation of each lift-out panel and contact adhesive thereon from the backing sheet.

7. The stock material defined in claim 6 wherein the business cards to be cut therefrom are generally rectangular and the marginal edge portions are at opposing sides of the lift-out panels, and with the adhesive release means forming continuous strips opposite and registering with the lift-out panels on the backing sheet with said corresponding marginal edge strip portions forming parallel strips separating the adhesive release means strips.

8. The stock material defined in claim 6 wherein said marginal edge portions of each card embrace and enclose each lift-out panel.

9. The card stock material defined in claim 6, wherein said score-cut across each card lies adjacent to the edge of the card.

10. The card stock material defined in claim 6, wherein said material is a rectangular sheet sized to form a number of rectangular business cards with a minimum waste of material and wherein the score-cut at each business card location extends about the card near the edges thereof defining a lift-out panel within the business card smaller than the card itself.

11. An improved business or calling card of the type having a removable panel which may be affixed to file cards or the like, said business card being of laminated construction and including:

(a) a face sheet which carries information in the form of printed indicia at its front side, said face sheet having a contact adhesive at its back side;

(b) a backing sheet secured to the face sheet by the contact adhesive;

(c) a score-cut means circumscribing an area of the face sheet which carries the printed indicia, said score-cut means delineating and defining a lift-out panel in the face sheet and a substantially continuous area disposed between the edges of the lift-out panel and the edges of the business card, which area substantially surrounds the lift-out panel; and (d) a release means on the backing sheet disposed so as to substantially engage only the lift-out panel of the face sheet yet extending a short distance therebeyond into the surrounding area of the face sheet to permit the lift-out panel to be positively and easily separated at the score-cut means and removed from the body of the card with the contact adhesive at the back side of the lift-out panel remaining intact, while the remainder of the face sheet which substantially surrounds the lift-out panel along with the corresponding portion of the backing sheet remain tightly and permanently bonded together by the contact adhesive;

whereby the lift-out panel is protected from inadvertent separation from the business card during handling thereof by virtue of the permanently bonded area which substantially surrounds the lift-out panel.

* * * * *